US010292425B2

(12) United States Patent
Liu

(10) Patent No.: US 10,292,425 B2
(45) Date of Patent: May 21, 2019

(54) TOBACCO BAKING DEVICE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 909 days.

(21) Appl. No.: 14/791,497

(22) Filed: Jul. 6, 2015

(65) Prior Publication Data

US 2016/0286861 A1 Oct. 6, 2016

(30) Foreign Application Priority Data

Mar. 30, 2015 (CN) ..... 2015 1 0143183

(51) Int. Cl.
*H05B 1/02* (2006.01)
*A24F 47/00* (2006.01)

(52) U.S. Cl.
CPC ..... *A24F 47/008* (2013.01); *H05B 1/0202* (2013.01); *H05B 1/0252* (2013.01)

(58) Field of Classification Search
CPC ..... A24F 47/008; A24F 47/002; A24F 47/00; A24F 13/00; A24F 13/02
USPC ..... 392/386; 131/328, 329, 330, 187
See application file for complete search history.

(56) References Cited

U.S. PATENT DOCUMENTS 5,649,554 A * 7/1997 Sprinkel ..... A24F 47/008 128/202.21
6,053,176 A * 4/2000 Adams ..... A24F 47/008 128/202.21
7,185,659 B2 * 3/2007 Sharpe ..... A24F 47/008 131/194
7,234,470 B2 * 6/2007 Yang ..... A24F 47/008 131/185
2007/0074734 A1 * 4/2007 Braunshteyn ..... A24F 13/00 131/328
2009/0007926 A1 * 1/2009 Gidding ..... A24F 13/00 131/331
2012/0234821 A1 * 9/2012 Shimizu ..... A24F 13/00 219/227
2015/0245654 A1 * 9/2015 Memari ..... A24F 15/12 141/2

* cited by examiner

*Primary Examiner* — Tu B Hoang
*Assistant Examiner* — Alba T Rosario-Aponte
(74) *Attorney, Agent, or Firm* — Matthias Scholl P.C.; Matthias Scholl

(57) ABSTRACT

A tobacco baking device, including: an upper housing, an inner frame, an electrical core, a heating core, a temperature sensor, a PCBA control board, a stainless steel tube, and a temperature control device. The inner frame includes a first end including a first hole and a second end including a second hole, the first hole being larger than the second hole. The heating core is disposed at a left side of the inner frame. The stainless steel tube surrounds the heating core, and the heating core is disposed in parallel to the stainless steel tube; the heating core is connected to the temperature control device and the temperature sensor. The temperature control device is connected to the temperature sensor and detects a heating temperature of the heating core in real time via the temperature sensor, whereby controlling the heating temperature to be constant.

19 Claims, 4 Drawing Sheets

TOBACCO BAKING DEVICE

CROSS-REFERENCE TO RELATED APPLICATIONS

Pursuant to 35 U.S.C. § 119 and the Paris Convention Treaty, this application claims the benefit of Chinese Patent Application No. 201510143183.7 filed Mar. 30, 2015. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a tobacco baking device.

Description of the Related Art

Typically, a tobacco baking device can only handle a small amount of tobacco at one time, so that the produced smoke volume cannot meet the demand of users. In addition, the loading operation for the tobacco is troublesome.

SUMMARY OF THE INVENTION

In view of the above-described problems, it is one objective of the invention to provide a tobacco baking device that is adapted to connecting to an electronic atomizer.

To achieve the above objective, in accordance with one embodiment of the invention, there is provided a tobacco baking device. The tobacco baking device comprises: an upper housing, an inner frame, an electrical core, a heating core, a temperature sensor, a printed circuit board assembly (PCBA) control board, a stainless steel tube, and a temperature control device. The inner frame comprises a first end comprising a first hole and a second end comprising a second hole, and the first hole is larger than the second hole. The heating core is disposed at a left side of the inner frame. The stainless steel tube surrounds the heating core, and the heating core is disposed in parallel to the stainless steel tube. The heating core is connected to the temperature control device and the temperature sensor. The temperature control device is connected to the temperature sensor. When in use, the temperature control device detects a heating temperature of the heating core in real time via the temperature sensor, whereby controlling the heating temperature to be constant.

In a class of this embodiment, an electronic atomizer is mounted on a top of the tobacco baking device.

In a class of this embodiment, one end of the stainless steel tube is fixed by an upper ceramic pedestal, and the other end of the stainless steel tube is fixed by a lower ceramic pedestal. A tip of the heating core is inserted into the stainless steel tube via an inner hole of the lower ceramic pedestal.

In a class of this embodiment, the stainless steel tube is inserted into the inner frame via the first hole thereof. The lower ceramic pedestal is connected to a fixing ring for fixing the ceramic pedestal. The fixing ring is disposed in a gap between the lower ceramic pedestal and the second end comprising the second hole of the inner frame.

In a class of this embodiment, the temperature sensor is connected to an outer part of the tip of the heating core, and a lead thereof is connected to the PCBA control board. The PCBA control board is provided with the temperature control device.

In a class of this embodiment, the tobacco baking device further comprises a key panel and a first fixing pedestal for fixing a first press key. The PCBA control board, the key panel, and the first fixing pedestal are mounted inside the upper housing. The PCBA control board is fixed by a screw. The first press key is mounted into the first fixing pedestal from a right side hole of the upper housing.

In a class of this embodiment, the tobacco baking device further comprises a seal support. The upper housing is connected to a second fixing pedestal for fixing the upper housing. A seal support is disposed in the second fixing pedestal. A slotted end of the second fixing pedestal is connected to the upper housing and the other end of the second fixing pedestal is connected to the inner frame.

In a class of this embodiment, the tobacco baking device further comprises a charging board. The charging board is tightly cooperated with and inserted into a relative small hole at a right side of a bottom of the inner frame.

In a class of this embodiment, the inner frame is disposed in the lower housing. A pin is inserted from one end comprising a relative small hole of the lower housing and passes through a hole of the inner frame into the other end of the lower housing for fixing the inner frame.

In a class of this embodiment, the tobacco baking device further comprises a decoration ring. The decoration ring is disposed at a gap between the upper housing and the lower housing.

The tobacco baking device further comprises a third fixing pedestal for fixing a cigarette. One end of the third fixing pedestal is connected to a spring, and the other end of the third fixing pedestal is connected to a second press key.

Advantages according to embodiments of the invention are summarized as follows:

First, the cigarette is placed in the tobacco baking device to produce the smoke. The electronic atomizer is mounted on the end face of the tobacco baking device. When the smoker inhales with the mouth contacting the atomizer, the water vapor and the smoke smell are produced, thereby making the smoker feel like smoking the real cigarette. In addition, no tar is produced, thereby being harmless.

Second, the atomizer and the device for heating and roasting the cigarette can be integrated as a whole, so that the large smoke volume and the smell of the reg cigarette are realized.

Third, the heating device is provided with the temperature sensor in order to keep the temperature balance.

Fourth, the DC heating device is adopted to roast the cigarette. The common cigarette can be directly placed into the heating device for roasting, thereby being convenient and fast. And the cigarette is quickly and uniformly heated.

Fifth, the heating core is disposed parallel inside the stainless steel tube, the two ends of the heating core are fixed by the ceramics, so that the heat is prevented from dissipation to the utmost and the efficiency for roasting the cigarette is much better without burning the hands.

BRIEF DESCRIPTION OF THE DRAWINGS

The invention is described hereinbelow with reference to the accompanying drawings, in which.

DETAILED DESCRIPTION OF THE EMBODIMENTS

Figure 1:
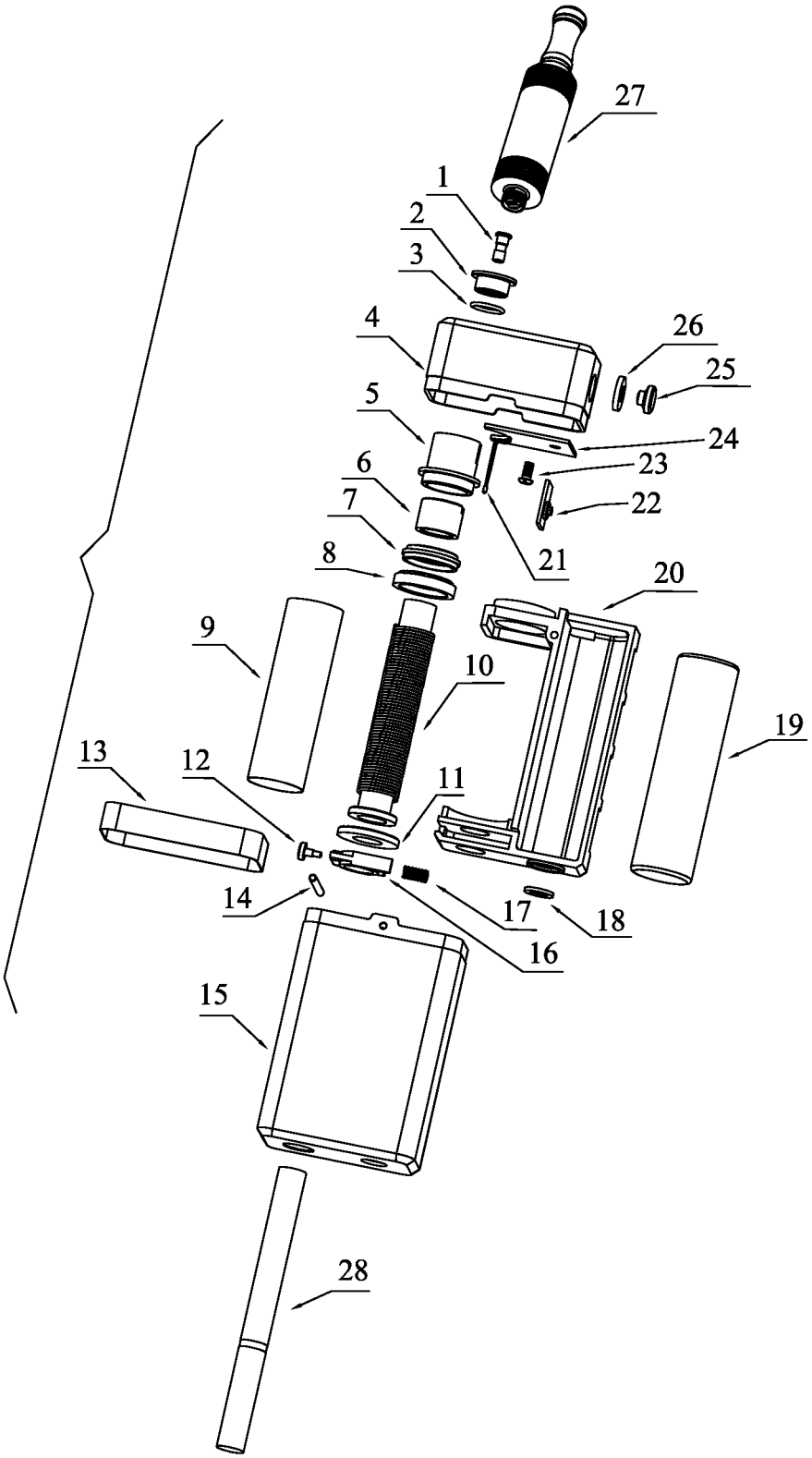
FIG. 1 is an exploded view of a tobacco baking device in accordance with one embodiment of the invention.
Figure 2:
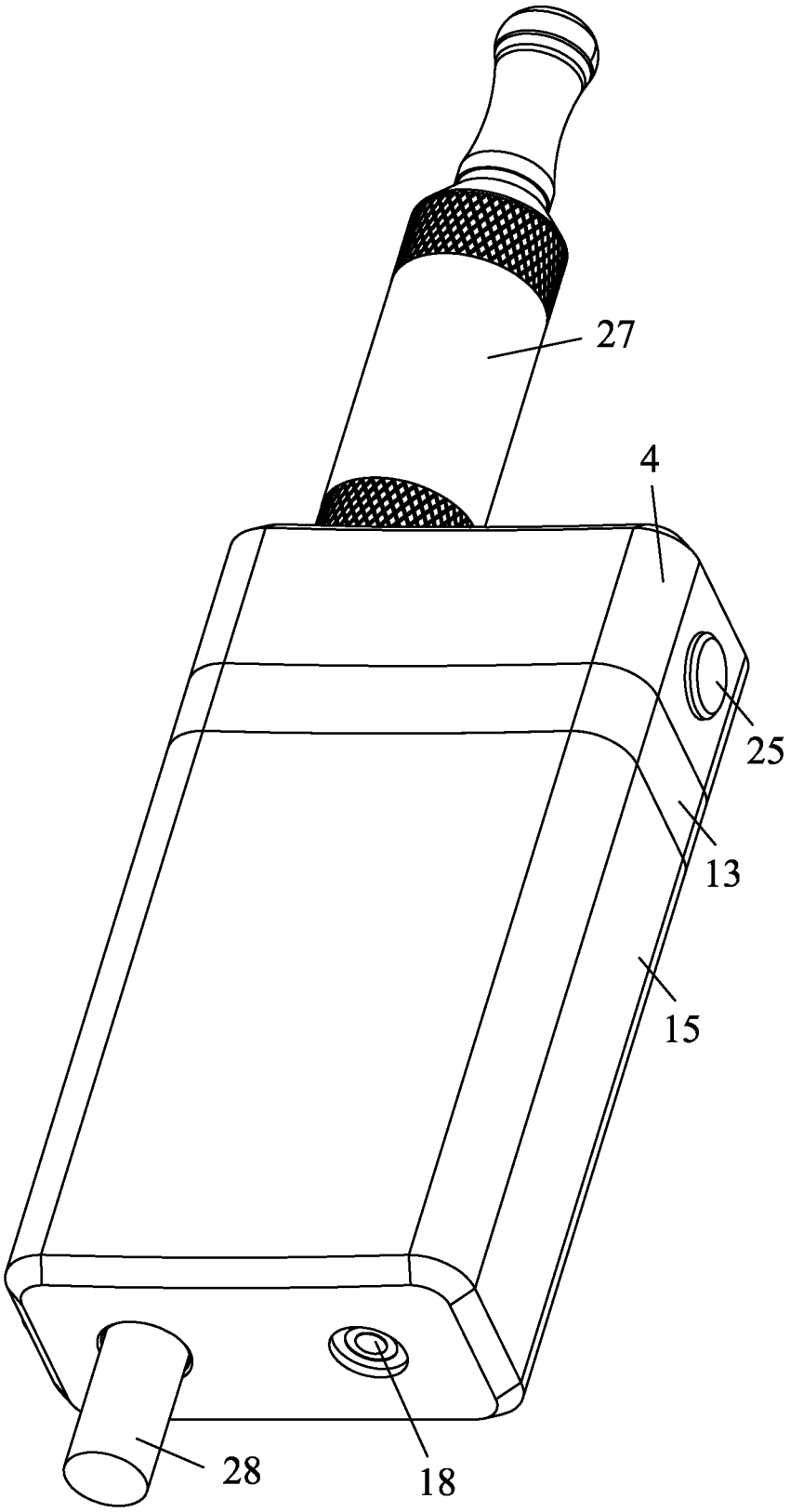
FIG. 2 is a stereogram of a tobacco baking device in accordance with one embodiment of the invention.
Figure 3:
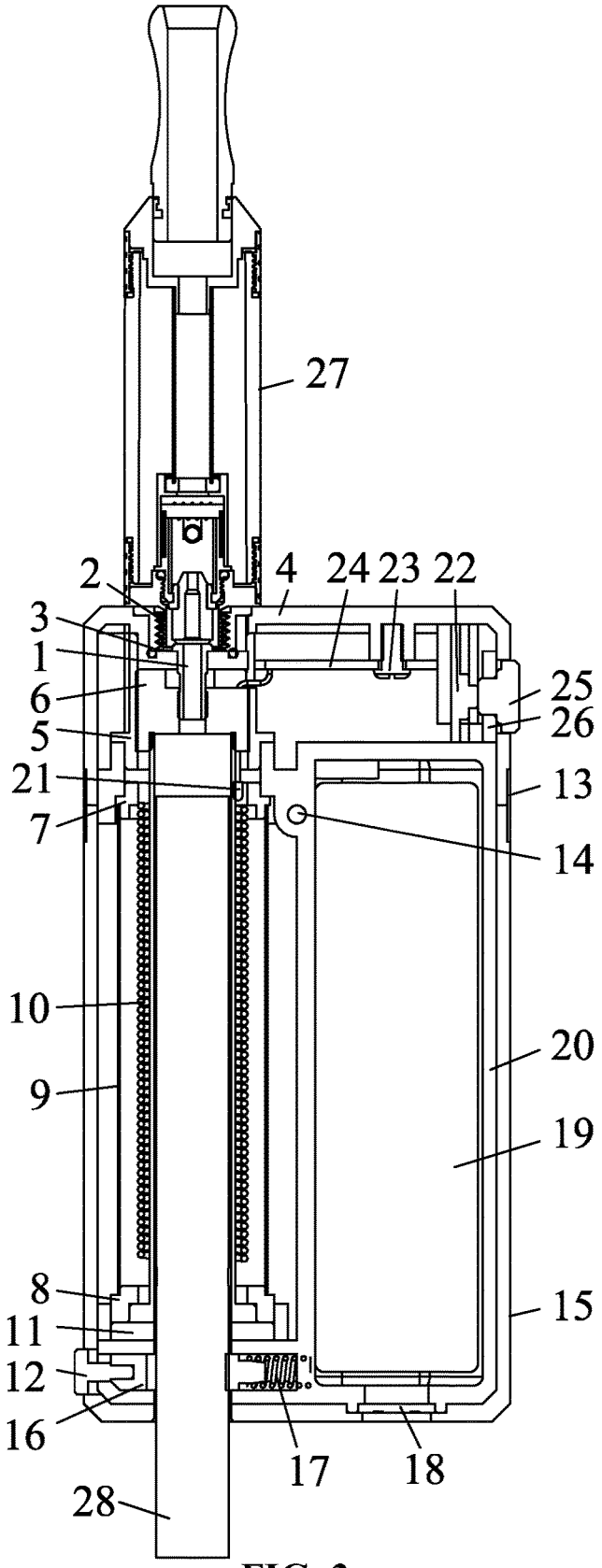
FIG. 3 is a sectional view of a tobacco baking device in accordance with one embodiment of the invention.
Figure 4:
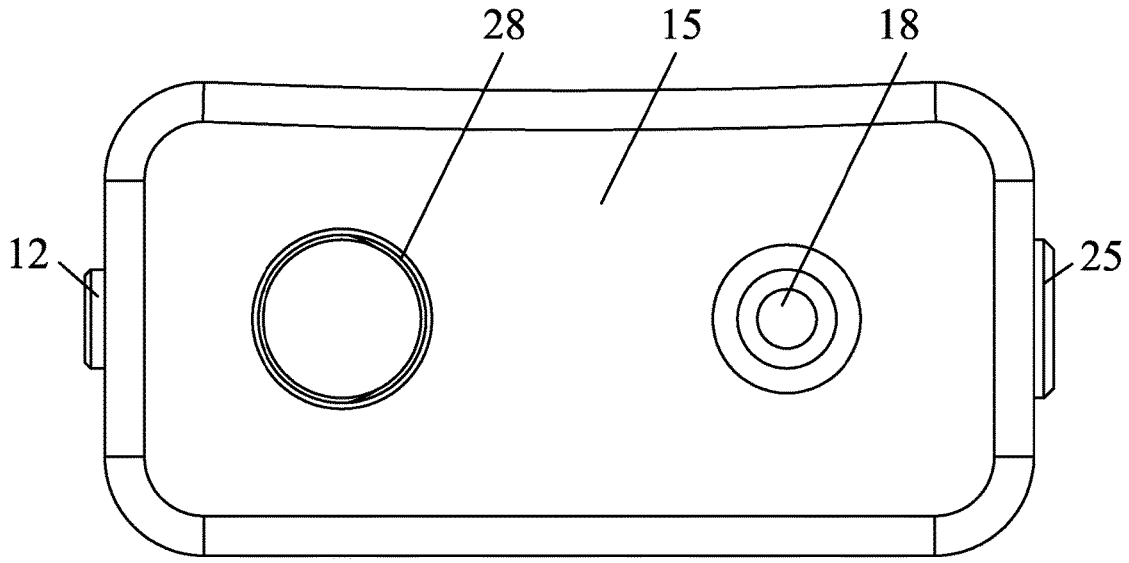
FIG. 4 is a bottom view of a tobacco baking device in accordance with one embodiment of the invention.
Figure 5:
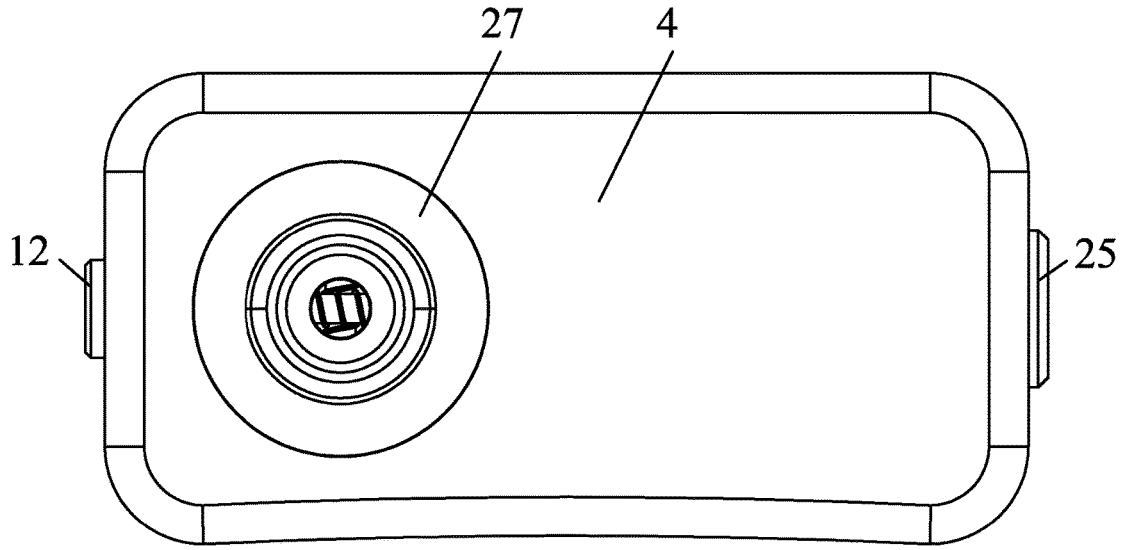
FIG. 5 is a top view of a tobacco baking device in accordance with one embodiment of the invention.

For further illustrating the invention, experiments detailing a tobacco baking device are described below. It should be noted that the following examples are intended to describe and not to limit the invention.

Specifically, a tobacco baking device comprises: an upper housing 4, an inner frame 20, an electrical core 19, a heating core 10, a temperature sensor 21, and a PCBA control board 24. The inner frame 20 comprises a first end comprising a first hole and a second end comprising a second hole, and the first hole is larger than the second hole. The heating core 10 is disposed at a left side of the inner frame 20. The stainless steel tube 9 surrounds the heating core 10. The heating core 10 is disposed parallel in the stainless steel tube 9. The heating core 10 is connected to a temperature control device and a temperature sensor. The temperature control device is connected to the temperature sensor, and when in use, the temperature control device detects a heating temperature of the heating core 10 in real time via the temperature sensor, whereby controlling the heating temperature to be constant.

An electronic atomizer 27 is mounted on a top of the tobacco baking device.

One end of the stainless steel tube 9 is fixed by an upper ceramic pedestal 7, and the other end of the stainless steel tube 9 is fixed by a lower ceramic pedestal 8. A tip of the heating core 10 is inserted into the stainless steel tube 9 via an inner hole of the lower ceramic pedestal 8.

The stainless steel tube 9 is inserted into the inner frame 20 via the first hole thereof. The lower ceramic pedestal 8 is connected to a fixing ring 11 for fixing the ceramic pedestal. The fixing ring 11 is disposed in a gap between the lower ceramic pedestal 8 and the second end comprising the second hole of the inner frame.

The temperature sensor 21 is connected to an outer part of the tip of the heating core 10, and a lead thereof is connected to the PCBA control board 24. The PCBA control board is provided with the temperature control device.

The tobacco baking device further comprises a key panel 22 and a first fixing pedestal 26 for fixing a first press key. The PCBA control board 24, the key panel 22, and the first fixing pedestal 26 are mounted inside the upper housing 4. The PCBA control board 24 is fixed by a screw 23. The first press key 25 is mounted into the first fixing pedestal 26 from a right side hole of the upper housing 4.

The tobacco baking device further comprises a seal support 6. The upper housing 4 is connected to a second fixing pedestal 5 for fixing the upper housing. A seal support 6 is disposed in the second fixing pedestal 5. A slotted end of the second fixing pedestal 5 is connected to the upper housing 4 and the other end of the second fixing pedestal 5 is connected to the inner frame 20.

The tobacco baking device further comprises a charging board 18. The charging board 18 is tightly cooperated with and inserted into a relative small hole at a right side of a bottom of the inner frame 20.

The inner frame is disposed in the lower housing 15. A pin 14 is inserted from one end comprising a relative small hole of the lower housing 15 and passes through a hole of the inner frame 20 into the other end of the lower housing 15 for fixing the inner frame.

The tobacco baking device further comprises a decoration ring 13. The decoration ring 13 is disposed at a gap between the upper housing 4 and the lower housing 15.

More specifically, the tobacco baking device comprises: the stainless steel tube 9, the upper ceramic pedestal 7, the lower ceramic pedestal 8, the heating core 10, the inner frame 20, the fixing ring 11 for fixing the ceramic pedestal, the temperature sensor 21, the PCBA control board 24, the key panel 22, the first fixing pedestal 26, the upper housing 4, the first press key 25, the screw 23, the second fixing pedestal 5, the seal support 6, the electrical core 19, the charging board 18, the lower housing 15, the pin, the decoration ring 13, the seal ring 3, an inner threaded copper ring 2, and a joint 1. The electronic atomizer 27 is mounted on the top of the tobacco baking device.

One end of the stainless steel tube 9 is fixed by the upper ceramic pedestal 7 and the other end of the stainless steel tube is fixed by the lower ceramic pedestal 8. The heating core 10 is disposed in the stainless steel tube. A combination of the stainless steel tube 9 and the heating core 10 is mounted in the inner frame 20. The fixing ring 11 is disposed in the gap between the lower ceramic pedestal 8 and the second end comprising the second hole of the inner frame so as to fix the combination of the stainless steel tube 9 and the heating core 10. The temperature sensor 21 is connected to the outer part of the tip of the heating core 10. The PCBA control board 24, the key panel 22, and the first fixing pedestal 26 are disposed in the upper housing 4. The first press key 25 passes through the right side hole of the upper housing 4 and is mounted on the first fixing pedestal 26. The seal support 6 is disposed in the second fixing pedestal 5. The slotted end of the second fixing pedestal 5 is connected to the upper housing 4 and the other end of the second fixing pedestal 5 is connected to the inner frame 20. The electrical core 19 after wire bonding is disposed in the inner frame. The charging board 18 is disposed in the inner frame 20. An integrated inner frame part after assembly is disposed in the lower housing 15, and the pin 14 is inserted into the relatively small hole for fixing the inner frame. The decoration ring 13 is disposed at the gap between the upper housing 4 and the lower housing 15. The seal ring 3, the inner threaded copper ring 2, and the joint 1 are respectively mounted in the inner frame. The electronic atomizer 27 is connected to an end face of the heating device via threaded cooperation. The cigarette 28 is accommodated by the heating core 10.

The tobacco baking device further comprises a third fixing pedestal 16 for fixing a cigarette. One end of the third fixing pedestal 16 is connected to a spring 17, and the other end of the third fixing pedestal 16 is connected to a second press key 12.

The device is capable of roasting the cigarette at a constant temperature, and a mist is produced by the atomizer, so that such the device is able to mix the smell of the cigarette and the mist together.

The heating core of the invention is able to accommodate the common cigarette and features convenient use, rapid temperature rise, and uniform heating. The temperature sensor is disposed on the surface of the heating core to detect the heating temperature in real time. The PCBA control board is adapted to control the heating temperature in time to reach baking at the constant temperature and better flavor of the cigarette. The heating core is disposed in the stainless steel tube, and two ends thereof are fixed by ceramics, which greatly restricts the heat dissipation and improves the baking efficiency. The smoke of the cigarette is released from the baking. In addition, the smoke of the cigarette after the baking at the constant temperature and the mist from the atomization of the electronic atomizer are mixed together, thereby making the smoker feel like smoking the real cigarette.

Advantages of the invention are as follows:

First, the cigarette is placed in the tobacco baking device to produce the smoke. The electronic atomizer is mounted on the end face of the tobacco baking device. When the smoker inhales with the mouth contacting the atomizer, the water vapor and the smoke smell are produced, thereby making the smoker feel like smoking the real cigarette. In addition, no tar is produced, thereby being harmless.

Second, the atomizer and the device for heating and roasting the cigarette can be integrated as a whole, so that the large smoke volume and the smell of the reg cigarette are realized.

Third, the heating device is provided with the temperature sensor in order to keep the temperature balance.

Fourth, the DC heating device is adopted to roast the cigarette. The common cigarette can be directly placed into the heating device for roasting, thereby being convenient and fast. And the cigarette is quickly and uniformly heated.

Fifth, the heating core is disposed parallel inside the stainless steel tube, the two ends of the heating core are fixed by the ceramics, so that the heat is prevented from dissipation to the utmost and the efficiency for roasting the cigarette is much better without burning the hands.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A tobacco baking device, comprising:

a) an upper housing;

b) an inner frame, the inner frame comprising a first end comprising a first hole and a second end comprising a second hole, the first hole being larger than the second hole;

c) an electrical core;

d) a heating core;

e) a temperature sensor;

f) a printed circuit board assembly (PCBA) control board;

g) a stainless steel tube; and h) a temperature control device;

wherein:

the heating core is disposed at a left side of the inner frame;

the stainless steel tube surrounds the heating core, and the heating core is disposed in parallel to the stainless steel tube;

the heating core is connected to the temperature control device and the temperature sensor; the temperature control device is connected to the temperature sensor; and when in use, the temperature control device detects a heating temperature of the heating core in real time via the temperature sensor, whereby the temperature control device controls the heating temperature to be constant;

one end of the stainless steel tube is fixed by an upper ceramic pedestal, and the other end of the stainless steel tube is fixed by a lower ceramic pedestal; and a tip of the heating core is inserted into the stainless steel tube via an inner hole of the lower ceramic pedestal.

2. The tobacco baking device of claim 1, wherein an electronic atomizer is mounted on a top of the tobacco baking device.

3. The tobacco baking device of claim 1, wherein the stainless steel tube is inserted into the inner frame via the first hole thereof; the lower ceramic pedestal is connected to a fixing ring for fixing the ceramic pedestal; and the fixing ring is disposed in a gap between the lower ceramic pedestal and the second end comprising the second hole of the inner frame.

4. The tobacco baking device of claim 1, wherein the temperature sensor is connected to an outer part of the tip of the heating core, and a lead thereof is connected to the PCBA control board; and the PCBA control board is provided with the temperature control device.

5. A tobacco baking device, comprising:

a) an upper housing;

b) an inner frame, the inner frame comprising a first end comprising a first hole and a second end comprising a second hole, the first hole being larger than the second hole;

c) an electrical core;

d) a heating core;

e) a temperature sensor;

f) a printed circuit board assembly (PCBA) control board;

g) a stainless steel tube;

h) a temperature control device;

i) a key panel; and j) a first fixing pedestal for fixing a first press key;

wherein:

the heating core is disposed at a left side of the inner frame;

the stainless steel tube surrounds the heating core, and the heating core is disposed in parallel to the stainless steel tube;

the heating core is connected to the temperature control device and the temperature sensor; the temperature control device is connected to the temperature sensor; and when in use, the temperature control device detects a heating temperature of the heating core in real time via the temperature sensor, whereby the temperature control device controls the heating temperature to be constant; and the PCBA control board, the key panel, and the first fixing pedestal are mounted inside the upper housing; the PCBA control board is fixed by a screw; and the first press key is mounted into the first fixing pedestal from a right side hole of the upper housing.

6. The tobacco baking device of claim 1, further comprising a seal support; wherein:

the upper housing is connected to a second fixing pedestal for fixing the upper housing; a seal support is disposed in the second fixing pedestal; a slotted end of the second fixing pedestal is connected to the upper housing and the other end of the second fixing pedestal is connected to the inner frame.

7. The tobacco baking device of claim 1, further comprising a charging board, wherein the charging board is tightly cooperated with and inserted into a third hole at a right side of a bottom of the inner frame.

8. A tobacco baking device, comprising:

a) an upper housing;

b) an inner frame, the inner frame comprising a first end comprising a first hole and a second end comprising a second hole, the first hole being larger than the second hole;

c) an electrical core;

d) a heating core;

e) a temperature sensor;

f) a printed circuit board assembly (PCBA) control board;

g) a stainless steel tube; and h) a temperature control device;

wherein:

the heating core is disposed at a left side of the inner frame;

the stainless steel tube surrounds the heating core, and the heating core is disposed in parallel to the stainless steel tube;

the heating core is connected to the temperature control device and the temperature sensor; the temperature control device is connected to the temperature sensor; and when in use, the temperature control device detects a heating temperature of the heating core in real time via the temperature sensor, whereby the temperature control device controls the heating temperature to be constant; and the inner frame is disposed in the lower housing; and a pin is inserted from one end comprising a through hole of the lower housing and passes through a third hole of the inner frame into the other end of the lower housing for fixing the inner frame.

9. The tobacco baking device of claim 1, further comprising a decoration ring; wherein the decoration ring is disposed at a gap between the upper housing and the lower housing.

10. The tobacco baking device of claim 5, wherein an electronic atomizer is mounted on a top of the tobacco baking device.

11. The tobacco baking device of claim 5, wherein the temperature sensor is connected to an outer part of the tip of the heating core, and a lead thereof is connected to the PCBA control board; and the PCBA control board is provided with the temperature control device.

12. The tobacco baking device of claim 5, further comprising a seal support;

wherein:

the upper housing is connected to a second fixing pedestal for fixing the upper housing;

a seal support is disposed in the second fixing pedestal; and a slotted end of the second fixing pedestal is connected to the upper housing and the other end of the second fixing pedestal is connected to the inner frame.

13. The tobacco baking device of claim 5, further comprising a charging board, wherein the charging board is tightly cooperated with and inserted into a third hole at a right side of a bottom of the inner frame.

14. The tobacco baking device of claim 5, further comprising a decoration ring, wherein the decoration ring is disposed at a gap between the upper housing and the lower housing.

15. The tobacco baking device of claim 8, wherein an electronic atomizer is mounted on a top of the tobacco baking device.

16. The tobacco baking device of claim 8, wherein the temperature sensor is connected to an outer part of the tip of the heating core, and a lead thereof is connected to the PCBA control board; and the PCBA control board is provided with the temperature control device.

17. The tobacco baking device of claim 8, further comprising a seal support;

wherein:

the upper housing is connected to a second fixing pedestal for fixing the upper housing;

a seal support is disposed in the second fixing pedestal; and a slotted end of the second fixing pedestal is connected to the upper housing and the other end of the second fixing pedestal is connected to the inner frame.

18. The tobacco baking device of claim 8, further comprising a charging board, wherein the charging board is tightly cooperated with and inserted into a third hole at a right side of a bottom of the inner frame.

19. The tobacco baking device of claim 8, further comprising a decoration ring; wherein the decoration ring is disposed at a gap between the upper housing and the lower housing.

* * * * *